US006124678A

United States Patent [19]

Bishop et al.

[11] Patent Number: 6,124,678

[45] Date of Patent: Sep. 26, 2000

[54] FLUORESCENT LAMP EXCITATION CIRCUIT HAVING A MULTI-LAYER PIEZOELECTRIC ACOUSTIC TRANSFORMER AND METHODS FOR USING THE SAME

[75] Inventors: Richard Patten Bishop, Fairfax Station; Clark Davis Boyd, Hampton, both of Va.

[73] Assignee: Face International Corp., Norfolk, Va.

[21] Appl. No.: 09/415,391

[22] Filed: Oct. 8, 1999

Related U.S. Application Data

[60] Provisional application No. 60/103,528, Oct. 8, 1998.

[51] Int. Cl.[7] ..... H05B 37/02

[52] U.S. Cl. ..... 315/209 PZ; 315/209 R; 315/276; 315/224

[58] Field of Search ..... 315/209 PZ, 209 R, 315/276, 277, 278, 308, 224, 219

[56] References Cited

U.S. PATENT DOCUMENTS

| | | | |
|---|---|---|---|
| 5,548,189 | 8/1996 | Williams | 315/224 |
| 5,886,477 | 3/1999 | Honbo et al. | 315/209 PZ |
| 6,057,648 | 5/2000 | Nerone et al. | 315/209 R |

*Primary Examiner*—Don Wong
*Assistant Examiner*—Wilson Lee
*Attorney, Agent, or Firm*—Stephen E. Clark

[57] ABSTRACT

Fluorescent lamp excitation circuits are provided which use a resonating piezoelectric transformer along with complementary circuit components, to efficiently convert a DC first voltage to a transformer-output AC second voltage. In the preferred embodiment of the invention, A High Displacement Piezoelectric (HDP) transformer achieves sufficiently high voltage output to "cold fire" a gas discharge lamp. The disclosed circuit may be modified using conventional electrical sub-circuitry to pre-heat the cathodes of the lamp.

1 Claim, 8 Drawing Sheets

FLUORESCENT LAMP EXCITATION CIRCUIT HAVING A MULTI-LAYER PIEZOELECTRIC ACOUSTIC TRANSFORMER AND METHODS FOR USING THE SAME

This application claims benefit to U.S. provisional application No. 60/103,528 filed Oct. 8, 1998.

BACKGROUND OF THE INVENTION

1. Field of Invention

This invention relates to drive circuits for gas discharge lamps. More particularly, this invention relates to a fluorescent lamp power supply circuit that uses a multi-layer piezoelectric acoustic transformer to produce a high-frequency, high-voltage excitation output to drive the lamp.

2. Description of Prior Art

All gas discharge lamps, including fluorescent lamps, require ballasts to operate. The ballast provides a high initial voltage that is necessary initiate the discharge, then rapidly limits the lamp current to safely sustain operation.

There are two general types of ballasts, classified based on the kinds of electrical components used to build the ballast: Magnetic ballasts and electronic ballasts.

Magnetic Ballasts consists of a transformer and a capacitor encased in an insulating material. In 1990 U.S. energy standards began requiring that standard magnetic ballasts no longer be sold, although these older ballasts still make up the majority of fluorescent ballast installations. Magnetic ballasts sold after 1990 bear the designation "energy-saving", and are about eight percent more efficient than older ballasts. The lamp operating frequency is 60 Hz, the same as the input frequency. Electronic ballast have many advantages over magnetic ballasts, including reduced flicker, noise, heat, size and weight, and increased lighting efficacy, high power factor and low total harmonic distortion (THD).

Electronic Ballasts use a variety of electronic components to convert the lamp operating frequency from 60 Hz to 20–40 kHz. The high frequency operation reduces internal losses in the lamp and conserves energy.

FIGS. 1 and 2 illustrate two exemplary prior electronic ballast circuits. FIG. 1 illustrates a prior ballast circuit comprising an oscillator IC (U1) and three field effect transformers (Q1, Q2 and Q3), among other components, such as may typically be used in a 24 watt fluorescent lamp ballast. FIG. 2 illustrates a prior ballast circuit comprising a pair of field effect transformers (Q1 and Q2) and a step-up electromagnetic transformer T1, among other components.

An overview of the operation of these two prior ballast circuits is useful in order to appreciate the advantages that the present invention provides.

Referring first to FIG. 1: FIG. 1 schematically illustrates a typical prior ballast circuit as may be used to power a 24 watt compact fluorescent lamp 50. In FIG. 1 the lamp 50 has cathode connections J3, J4, J5 and J6. A 60 Hz alternating current input AC provides power to the circuit. Capacitor C7 is provided to reduce EMI from escaping the circuit and going back up to the AC line. The capacitor C7 essentially opens the circuit for 60 Hz operation, but it shorts for a frequency of about 60 kHz, which is the frequency at which this circuit normally operates. The rectifier bridge BR1 produces DC voltage at about 170 volts, nominal. This voltage is not ground referenced, it is a floating reference such that there is a 170 volt difference from one side of the circuit to the other.

Coming out of the bridge rectifier BR1 is a 47 microfared 200 volt capacitor C1, which reduces the ripples in the rectified current. A 100 uH inductor L1 is provided to isolate the high frequency current pulses that are being drawn from the positive rails. Resistor R1 (270K) provides a small amount of current to start oscillator U1. The oscillator U1 generates gate control voltages for the field effect transformers Q1 and Q2 (FETS) that are connected to pins 5 and 7, which are marked HV (high voltage gate) and LVG (low voltage gate), respectively.

The low voltage gate (LVG) line (pin 5) is connected to FET Q2, which can be driven with only 10 to 15 volts at the gate. On the other hand, the source of FET Q1 is connected to the output signal of FET Q2, so that it is necessary to be 10 or 15 volts above that source value. When FET Q1 is turned on the voltage on the output line (pin 6) rises up to the rail voltage of 170 volts. Oscillator U1 pin 8 (marked "boot"), generates internally high "boot strap voltage", which can go above the rail voltage, so that the gate of Q1 may become turned on when it goes up to the high voltage supply. A square wave comes out of pin 6 of the oscillator U1 and is coupled back to capacitor C10. That pulsing square wave enables the generation of a high voltage which is used to drive the gate on the high side FET Q1.

Resistors R3 and R4 are located at the gates of the two transistors Q1 and Q2. One series gate resistance prevents the transistors Q1 and Q2 from self oscillation at very high frequencies, (which could be destructive, as its generates a lot of EMI). This resistance has a tendency to slow down the rise time somewhat, which reduces EMI.

Capacitor C3 and inductor L2 are in series with cathode 1A of the lamp. The inductor L2 is composed of a parallel dual winding on a single core. Parallel dual winding is used to reduce the skin effects at high frequency. Skin effect is predicted by Lens Law which states that in a current carrying wire, the thicker the wire the larger the self induced current. That self induced current has a tendency to travel in the opposite direction down the center of the wire. Accordingly, if the cross section of the wire is minimized, the surface area of the wire is maximized, which permits the maximum forward current, the minimum reverse current. Thus impedance at high frequencies (i.e. series resistance) is reduced, which would result in high losses if the skin effect weren't reduced. Typically such prior circuits use wire comprising many fine strands. Capacitor C3 and inductor L2 form a series resonance circuit. A series resonance circuit can be used in this manner to generate a large voltage swing such as is typically required in prior fluorescent lighting circuits in order to "fire" the lamp. When that series resonance circuit is driven at its resonant frequency, it generates a high voltage that will fire the lamp.

Resistor R5 and capacitor C13 at the output of the transistors Q1 and Q2 provide a "snubber circuit". The series resonance circuit, which comprises a large inductor L2, can result in "overshoot" and "ringing" unless a snubber circuit is used to prevent such effects, e.g. by dissipating a small amount of energy into the air and by reducing the rise time of the voltage so as to help control very high frequency EMI. Some of the energy is picked off from the snubber circuit runs through capacitor C5, diode D2 and diode D1, and back over to pin 1. When this circuit is running it requires significantly more current to drive the gates at this frequency, because these gates are capacited and it is necessary to charge and discharge them. So, if resistor R1 were low enough value to supply the gate current that is required from 170 volts to bring it down to 15 volts that is internally regulated on this device, it would dissipate a lot of energy (on the order of 2 watts) in resistor R1. However, since there essentially exists a miniature switching power supply in capacitor C5, diode D2 and diode D1, once the circuit starts, it uses the switched output voltage to generate the current necessary to keep the device running. During start up, capacitor C2 is initially brought up to voltage by resistor R1 and it supplies enough current during start up to run the gates. After a cycle or two of operation, currently is already being supplied back from the feedback circuit, the circuit/lame can continue to run.

Capacitors C8 and C6, along with resistor R10 form a capacitive type voltage divider, past the resistive voltage divider. R10 is only 1 OHM. There is a 1 ohm difference between the low voltage sides of capacitors C8 and C6 (which are connected to the source of FET Q3) and the ground reference for the oscillator U1 at pin 4. Part of the energy being used to drive the circuit in the lamp is, in this manner, fed back to FET Q3.

Field effect transistor Q3 starts in the "off" position. The drain of FET Q3 is connected to the junction of capacitors C9 and C11. The series combination of capacitors C9 and C11 is attached to oscillator pin 3, which is also attached to resistor R2. The R-C time constant of resistor R2 and the series capacitance (C9 and C11) determines the operating frequency. The capacitance (at pin 3, "CF") and the resistance (at pin 2, "RF) are used to set the frequency. So, initially when the circuit starts running, resistor R2 and the combination of capacitors C9 an C11 control the frequency. That frequency is not at the resonant frequency of the resonant circuit; and, because it is not at the resonant frequency of the resonant circuit, the voltage that the lamp sees is lower then it sees at the resonance frequency. However, attached to junctions J3 and J4 is a filament. So, the frequency initially seen by the filament between junctions J3 and J4 is lower frequency than the running frequency. The current at that (lower) frequency goes out of junction J3 and, not through the lamp tube to junction J6, but through the filament over to J4, thence through the capacitor C14, back out of junction J5 through the second filament to junction J6.

During that phase of start-up, the filaments begin to heat, and this heating condition continues as long as the tube is not fired. So, during this start-up phase, capacitor C12 has virtually no charge when the power is first turned on, and it begins charging through resistors R1 and R6, and pin 1 of the oscillator U1 is maintained at 15 volts. The 15 volts applied to R6 charges capacitor C12. When capacitor C12 charges up to 10 volts plus the gate turn-on voltage. A zener diode D3 is used to block any of this charge-up voltage from getting to the gate of FET Q3 until the voltage is above 10 volts. The gate voltage at FET Q3 of about 2.5 volts is necessary to turn FET Q3 on. Resistor R7 insures that the gate of FET Q3 is pulled low and it just drains off any leakage current, so that once capacitor C12 charges up to about 12.5 volts, this FET Q3 turns on.

When FET Q3 (which has a resistance of about 1 ohm) turns on, it shorts out capacitor C11. When capacitor C11 is shorted out, the RC time consonant is determined solely by capacitor C9 and resistor R2. Since FET Q3 only has about one ohm resistance, its has little effect because the resistance of resistor R2 (which is on the order of 10.7K OHMS resistance) is so large.

With the filaments warm, as the frequency shifts the voltage rises at the lamp because the circuit is now running capacitor C3 and inductor L2 at resonance. Once the lamp fires, the voltage at the lamp across junctions J3 and J6 is typically up around 6 or 7 hundred volts peak-to-peak. Once the lamp fires it runs at about 80 volts RMS, or slightly 200 volts peak-to-peak. Now the capacitor filament series circuit (comprising capacitor C14), instead of seeing the higher voltage of approximately 350–400 volts peak-to-peak of the start up phase, is now only seeing a little over 200 volts peak-to-peak during the normal running phase. During normal running phase of the circuit the filaments no longer receive electric current to keep them warm; but, because the tube is fired, the plasma in the tube keeps the filaments hot.

In a hot cathode tube such as is used in this circuit, the goal is to heat up the filaments and, typically, they are required to be heated three to four times their initial resistance. In other words, at start up the filaments are heated up until their resistance is about 4 times their initial resistance. When the filaments begin to glow, the coating on the filaments emit electrons. This emission of electrons into the space of the tube reduces the voltage required to fire the tube. If a higher voltage or an electric field from an external trigger next to the tube is then applied, the atoms in the tube can be excited to a level where they can conduct. The conduction voltage depends on the vapor pressure of the mercury and temperature inside of the tube.

When the tube begins to conduct, the voltage between the two ends of the tube drops to the reduction voltage. The voltage at the filaments becomes much lower and, accordingly, their self heat is not as great. Once fired, the high temperature of the plasma in the tube is sufficient to keep the filaments warm, and, accordingly, little energy (on the order of 0.7 watts) is dissipated while the lamp is running.

The circuit depicted in FIG. 1 is typical of a 24 watt lamp/ballast. This circuit typically achieves about 85% efficiency. That is: the circuit draws about 24 watts, approximately 20.5 of which go to lighting the lamp.

Referring now to FIG. 2: FIG. 2 schematically illustrates a second type of prior electronic ballast for a fluorescent lamp. The circuit shown in FIG. 2 is a 15 watt circuit. Input to circuit (110 VAC, 60 Hz) is the same and rectified as described with respect to the circuit of FIG. 1.

This prior circuit has an N-channel FET Q1 and a P-channel FET Q2, whereas the circuit of FIG. 1 has two N-channel FET. The advantage of using an N-channel and a P-channel FET is that the two sources can be connected together. N-channel FETS (such as are used in the circuit of FIG. 1) are better for current and speed, but they much be connected starting from the high voltage supply down, so that the transistors are "stacked" drain, source, drain, source. In the circuit of FIG. 2, starting at the positive rail and going toward the negative rail, the FETS (Q1 and Q2) are arranged drain, source, source, drain.

In the circuit shown in FIG. 1, the ground reference internally in the circuit is on the negative side; so, the circuit operates off of 100 plus 170 volts. In the circuit shown in FIG. 2, virtual ground is generated by using a series combination of capacitors C2 and C3. The value of these capacitors C2 and C3 is about 0.22 uF. By connecting the ground between these two capacitors C2 and C3, the AC signals can swing (positive) above that ground and (negative) below that ground. This approach differs from the circuit shown in FIG. 1, in which circuit the ground reference can only be driven upward in the positive direction. The plus/minus supply scheme of the circuit shown in FIG. 2 enables the use of a combination of N-channel and P-channel FETS (Q1 and Q2), which simplifies the gate drive.

Field effect transistor Q2 is a P channel device, and FET Q1 is an N-channel device. Resistor R3 is connected attached to the positive voltage rail. When the circuit is first turned resistor R3 causes the voltage on the gate of the FET Q1 to rise until it turns on. When FET Q1 turns on, the voltage at its output line, which is connected to transformer T1, begins to rise, and continues to rise to the voltage of the positive rail.

The primary coil of transformer T1, which typically has about 100–102 turns, acts as an inductor. This "inductor" forms a series resonance circuit with capacitor C9 and the lamp.

The current through the secondary (6 turn) side of transformer T1 goes through inductor L2 and capacitor C5, (which is a series resonance circuit back), and back to the gates of the FETS Q1 and Q2. After the current reaches a peak, it begins to decay. As the magnetic fields decays this reverses the current flow through the inductor L2, which then begins to pull the gate voltage in the opposite direction.

Because resistor R1 is high resistance (270 kOhm) little current passes to the gates of FET Q1 or Q2. Thus, the gates of the FET Q1 and Q2 are essentially open when there is a strong AC signal, and this pulls the gate voltage down. In doing so, the voltage swings in the negative direction. Now FET Q2 turns on and FET Q1 turns off. The charge that was in the capacitors C9 and C6 attached to the lamp now begins to discharge through the transformer T1 to the minus side. When capacitors C6 and C9 have discharged, the voltage swings the other way, and the opposite condition exists. This, in turn, causes FET Q1 to turn on and FET Q2 to turn off.

Inductor L2 and capacitor C2 are set up to the same frequency as the primary of transformer T1 and the capacitance attached to the lamp. Additionally, it is noted that in this circuit the sources of the FETS Q1 and Q2 are connected together on the output line. Two zener diodes D1 and D2 are attached back to back to the source line. At any given time, one of the diodes (D1 or D2) will be forward biased and the other will be reversed biased.

The gate to source voltage determines whether an FET is turned on or off. However, that voltage must not exceed the gate source rating. The FETS typically used in prior circuits such as these are typically rated in the 15 to 20 volt range. The two zener diodes D1 and D2 are connected in series. The zener diodes are forward biased at approximately 0.7 volts. When the diodes are reverse biased they break down, yielding avalanche voltage at the zener voltage, which, in this case, is 10 volts. So, this combination of back to back zener diodes clamps the voltage that the gates of the FETS Q1 and Q2 at about 11 volts. This prevents the inductor-capacitor voltage from swinging too high, so as to prevent overheating of the gates of the FETS. A voltage divider is not used in this circuit because the differences between the start-up voltage and the running voltage would be too high, which would result in too much variation in the gate voltage. Instead, the voltage is allowed to run high and then is "clamped" with the diodes D1 and D2.

Resistors R4 and R5 in series with the gates of the FETS Q1 and Q2. Resistors R4 and R5 are basically for the same purpose: namely, they slow down the rise time and they prevent self oscillation.

Positive temperature coefficient resistor RT1 and capacitor C6 affect the resonance frequency slightly, so that the voltage is limited across the lamp. The PTC RT1 has a low resistance (approximately 300 ohms) at room temperature.

When the circuit is initially turned on, current flows through PTC RT1 and through the lamp filaments. As PTC RT1 begins to heat up it resistance increases rapidly. At the same time, the lamp filaments are also heating up. When the resistance of PTC RT1 gets high enough not to load down the circuit, the resonant frequency shifts because capacitor C6 becomes isolated from the rest part of the circuit. Then the voltage of transformer T1 and capacitor C9 begins to rise across the lamp. The filaments, now subjected to the high voltage, become hot, and the frequency begins to change more toward the resonant frequency and the lamp fires. Then once the lamp fires there is a much reduced voltage across the filaments and PTC RT1. There will still be some current flow through the PTC, but, because the PTC resistance has risen, it is able to dissipate most of its heat. The self heating of the PTC keeps its resistance in equilibrium at high level.

It will be noted that, once fired, although most of the current flows through the lamp filament, there is always a loss associated with current flow through the PTC.

Recent government regulations dictate the amount of EMI emissions that are allowed from fluorescent lamp ballasts, as well as the extent to which circuitry must provide lamp removal protection.

In view of the foregoing discussion, it would therefore be desirable to provide a power-supply and control circuit for a gas discharge lamp that uses a device with inherent fundamental characteristics that are more conducive to the device being used as a step-up transformer than the characteristics of a conventional magnetic-coil transformer.

It would also be desirable to provide a power-supply and control circuit for a gas discharge lamp that uses a device with inherent fundamental characteristics that are more conducive to the device being used as a step-up transformer than the characteristics of a conventional Rosen-type piezoelectric transformer.

It would also be desirable to provide a power-supply and control circuit for a gas discharge lamp using a step-up transformer that can be inherently made smaller in all dimensions than conventional magnetic transformers.

It would further be desirable to provide a power-supply and control circuit for a gas discharge lamp that can be made smaller than conventional circuits using either magnetic step-up transformers or prior piezoelectric transformers.

It would additionally be desirable to provide a power-supply and control circuit for a gas discharge lamp having a simpler construction than conventional, magnetic or piezoelectric, power-supply circuits.

It would still further be desirable to be able to provide such a gas discharge lamp power-supply and control circuit that uses a step-up transformer that does not require a sinusoidal input in order to generate a high-frequency, high-voltage AC output.

SUMMARY OF THE INVENTION

Accordingly, it is an object of this invention to provide a multi-layer piezoelectric transformer that has inherent fundamental characteristics that are conducive to being used as a step-up transformer in a gas discharge lamp power-supply and control circuit.

It is another object of this invention to provide a multi-layer piezoelectric transformer of the character described that has a relatively higher power transmission capability that comparably sized prior magnetic transformers and prior piezoelectric transformers.

It is another object of this invention to provide a multi-layer piezoelectric transformer of the character described in which, under certain operational conditions, the voltage gain of the device inherently varies, under certain operational conditions, substantially proportionately with the resistance of the load (i.e. at lower resistance, the gain of the device is lower; at higher resistance, the gain of the device is higher).

It is another object of this invention to provide a method for manufacturing such a multi-layer piezoelectric transformer.

It is also an object of this invention to provide a gas discharge lamp power-supply and control circuit that uses a transformer device of the character described with inherent fundamental characteristics that are more conducive to the device being used as a step-up transformer than the characteristics of conventional magnetic-coil transformers.

It is also an object of this invention to provide a gas discharge lamp power-supply and control circuit that uses a multi-layer transformer device of the character described with inherent fundamental characteristics that are more conducive to the device being used as a step-up transformer than the characteristics of conventional Rosen-type piezoelectric transformers.

It is also an object of this invention to provide a gas discharge lamp power-supply and control circuit that uses a step-up transformer that can be inherently made smaller in all dimensions than conventional magnetic transformers.

It is a further object of this invention to provide a gas discharge lamp power-supply and control circuit that can be made smaller than conventional circuits using magnetic step-up transformers or prior piezoelectric transformers.

It is an additional object of this invention to provide such a gas discharge lamp power-supply and control circuit having a simpler construction than conventional, magnetic or piezoelectric, power-supply circuits.

It is a further object of this invention to provide a gas discharge lamp power-supply and control circuit using a multi-layer transformer device of the character described that does not require a sinusoidal input in order to generate a high-frequency, high-voltage AC output.

It is another object to provide a modification of the mult-layer piezoelectric transformer that is adapted to be used in signal transmission applications wherein the voltage gain is substantially uniform over a wide input voltage frequency range, and a method for manufacturing same.

These and other objects of the invention are accomplished in accordance with the principles of the present invention with a multi-layer piezoelectric transformer that steps up voltage when operating at its natural ("resonant") frequency, but in which the voltage gain varies substantially directly with the magnitude of the resistance of the load at the output (secondary) side of the device. A power-supply and control circuit and method for driving a gas discharge lamp from a voltage DC source is accomplished in accordance with one embodiment of the present invention using such a multi-layer piezoelectric transformer.

BRIEF DESCRIPTION OF THE DRAWINGS

The above and other objects and advantages of the present invention will be apparent upon consideration of the following detailed description, taken in conjunction with accompanying drawings, in which like reference characters refer to like parts throughout, and in which.

DETAILED DESCRIPTION OF THE INVENTION

In order to overcome many of the problems inherent with the prior ("Rosen-type") piezoelectric transformers, including both manufacturing and application problems, the present invention provides a method of constructing a novel multi-layer piezoelectric transformer that is particularly well suited for use as a step-up transformer in gas discharge lamp power-supply and control circuits. Below is described the preferred embodiment of a multi-layer piezoelectric transformer and its use in a fluorescent lamp power-supply and control circuit. As will become evident from an understanding from the following disclosure, various embodiments of multi-layer piezoelectric transformers constructed in accordance with the present invention have many applications, as both step-up and step-down voltage transforming devices, and as both resonating and non-resonating electrical signal transmission devices. Accordingly, it will be understood that many variations of construction of the multi-layer piezoelectric transformer are within the scope of the present invention, and that the multi-layer transformer may be used in applications other than that disclosed with respect to the preferred embodiment. Furthermore, while the following disclosure describes the use of the multi-layer piezoelectric transformer in a fluorescent lamp power-supply and control circuit, it is within the scope of the present invention to use the an embodiment of the disclosed multi-layer piezoelectric transformer and an embodiment of the disclosed power-supply and control circuit as a ballast for gas discharge lamps other than fluorescent lamps, including, but not limited to, sodium vapor lamps, mercury vapor lamps, etc.

HIGH DEFORMATION PIEZOELECTRIC TRANSFORMER

Figure 7:
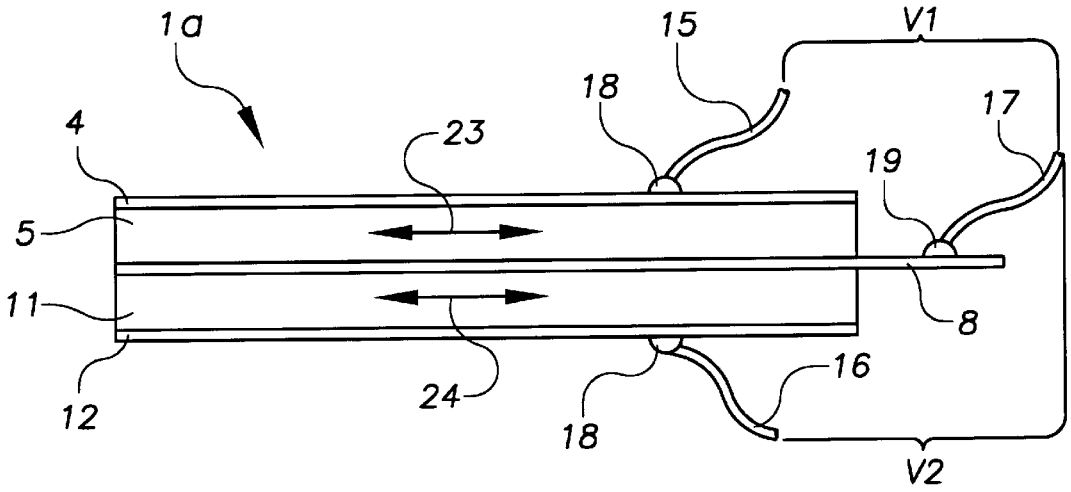
FIG. 7 is an elevation view showing a modified multi-layer piezoelectric transformer constructed in accordance with the present invention.

Referring to FIG. 7: A high deformation piezoelectric (HDP) transformer 1 a comprises a first piezoelectric ceramic layer 5 and a second piezoelectric ceramic layer 11. First and second piezoelectric ceramic layers 5 and 11 comprise discrete members bonded to a substantially flat intermediate electrode 8. The composite structure has a longitudinal plane that is substantially parallel to the planes of interface between the intermediate electrode 8 and first and second ceramic layers 5 and 11. Opposite outboard surfaces of ceramic layers 5 and 11 are electroded 4 and 12, respectively, such as by electro-depositing or the like. Electrodes 4 and 12 substantially extend over the entire outboard opposing surfaces of ceramic layers 5 and 11. The ceramic layers 5 and 11 are each electrically polarized (substantially throughout their respective masses) in the same direction, namely perpendicular to the longitudinal plane of the composite structure. In other words, ceramic layer 5 is polarized between electrode 4 and electrode 8 such that when a first voltage V1 of a first polarity is applied between electrode 4 and electrode 8, ceramic layer 5 tends to elongate (as indicated by arrow 23) in a direction parallel to the longitudinal plane of the composite structure; and when a voltage V1 of a second first polarity is applied between electrode 4 and electrode 8, ceramic layer 5 tends to contract in a direction parallel to the longitudinal plane of the composite structure. Similarly, ceramic layer 11 is polarized between electrode 12 and electrode 8 such that when a second voltage V2 of a first polarity is applied between electrode 12 and electrode 8, ceramic layer 11 tends to elongate (as indicated by arrow 24) in a direction parallel to the longitudinal plane of the composite structure; and when a voltage V2 of a second first polarity is applied between electrode 12 and electrode 8, ceramic layer 11 tends to contract in a direction parallel to the longitudinal plane of the composite structure.

Because ceramic layers 5 and 11 are constructed of piezoelectric materials, preferably PZT, which are transversely polarized, when a voltage V1 (of a first polarity) is applied across electrodes 4 and 8, ceramic layer 5 tends to piezoelectically elongate as indicated by arrows 23 in a direction substantially parallel to the longitudinal plane of the composite structure. This elongation (23) of ceramic layer 5 is translated to ceramic layer 11, which begins to elongate in a like direction. This substantially longitudinal elongation of ceramic layer 11 results in the piezoelectric generation of a second voltage V2 between electrodes 12 and 8. Similarly, when the polarity of the voltage V1 across electrodes 4 and 8 is reversed, a second voltage V2 of reverse polarity is developed between electrodes 12 and 8.

Figure 3:
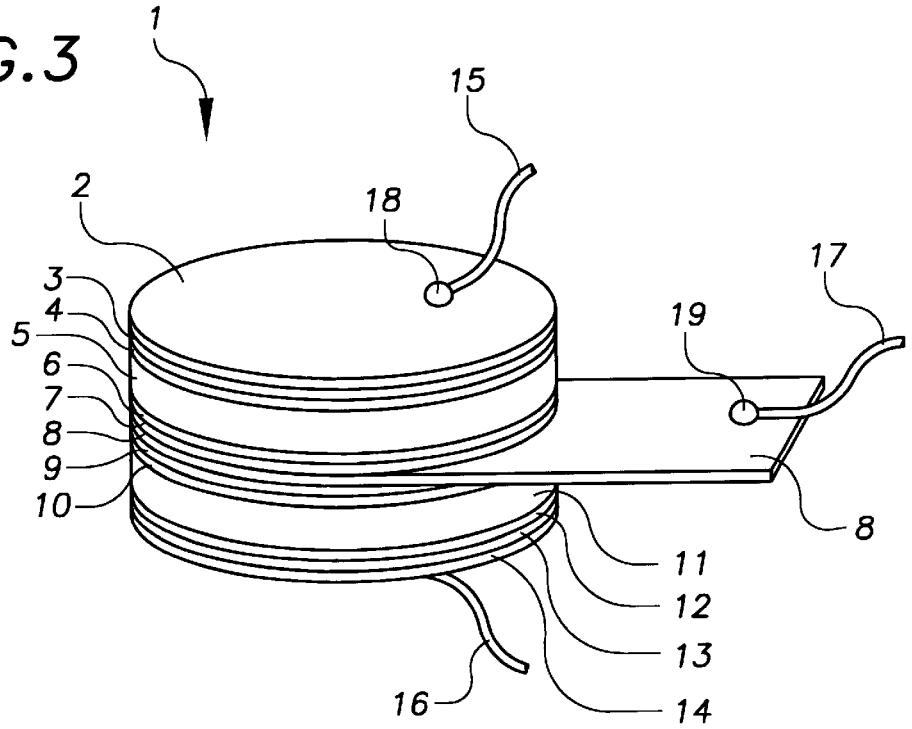
FIG. 3 is an perspective view of the multi-layer piezoelectric transformer constructed in accordance with the principles of the present invention.
Figure 4:
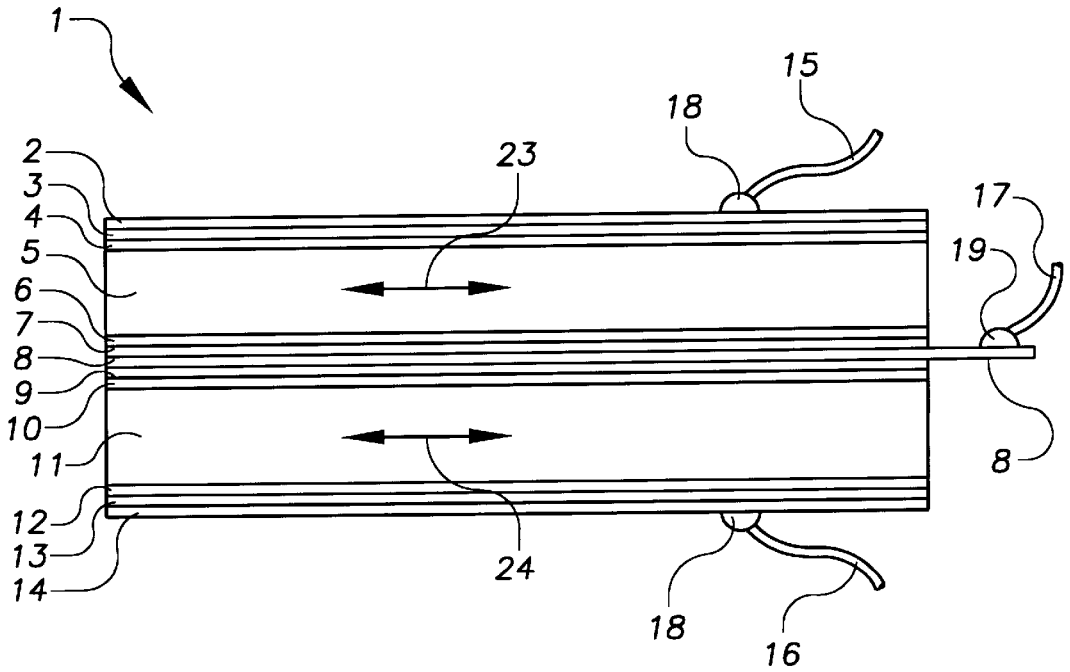
FIG. 4 is an elevation view showing the details of construction of the multi-layer piezoelectric transformer shown in FIG. 3.
Figure 5:
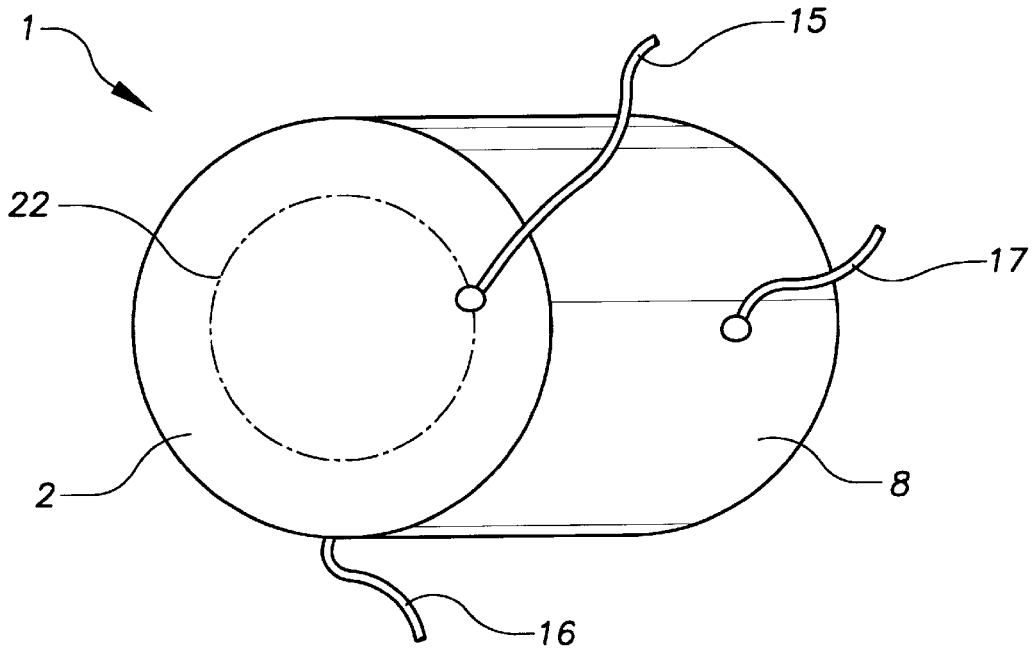
FIG. 5 is a is a plan view showing the top of the multi-layer piezoelectric transformer shown in FIG. 3.

Referring now to FIGS. 3–5: In the preferred embodiment of the invention, the HDP transformer 1 comprises a first piezoelectric ceramic layer 5 and a second piezoelectric ceramic layer 11. First and second piezoelectric ceramic layers 5 and 11 preferably comprise discrete members having electrodes 4 and 6, and 10 and 12, respectively, electro-deposited on their two opposing major faces. An adhesive 3, 7, 9 and 13, such as "Cibageigy AV118" as manufactured by Cibageigy, is used to bond a first exterior electrode 2 to electrode 4, an intermediate electrode 8 to first interior electrode 6, intermediate electrode 8 to second interior electrode 9, and second exterior electrode 14 to electrode 12, respectively.

The composite structure (1) has a longitudinal plane that is substantially parallel to the planes of interface between the intermediate electrode 8 and first and second ceramic layers 5 and 11. Electrodes 4, 6, 9 and 12 substantially extend over the respective opposing surfaces of ceramic layers 5 and 11. The ceramic layers 5 and 11 are each electrically polarized (substantially throughout their respective masses) in the same direction, namely perpendicular to the longitudinal plane of the composite structure (1). In other words, ceramic layer 5 is polarized between electrode 4 and electrode 6 such that when a first voltage of a first polarity is applied between electrode 4 and electrode 6, ceramic layer 5 tends to elongate (as indicated by arrow 23) in a direction parallel to the longitudinal plane of the composite structure; and when a first voltage of a second polarity is applied between electrode 4 and electrode 6, ceramic layer 5 tends to contract in a direction parallel to the longitudinal plane of the composite structure. Similarly, ceramic layer 11 is polarized between electrode 12 and electrode 9 such that when a second voltage of a first polarity is applied between electrode 12 and electrode 9, ceramic layer 11 tends to elongate (as indicated by arrow 24) in a direction parallel to the longitudinal plane of the composite structure; and when a voltage of a second first polarity is applied between electrode 12 and electrode 9, ceramic layer 11 tends to contract in a direction parallel to the longitudinal plane of the composite structure.

Because ceramic layers 5 and 11 are constructed of piezoelectric materials, preferably PZT, which are transversely polarized (i.e. perpendicular to the longitudinal plane of the composite structure), when a voltage (of a first polarity) is applied across electrodes 4 and 6, ceramic layer 5 tends to piezoelectically elongate as indicated by arrows 23 in a direction substantially parallel to the longitudinal plane of the composite structure. This elongation (23) of ceramic layer 5 is translated to ceramic layer 11, which begins to elongate in a like direction. This substantially longitudinal elongation of ceramic layer 11 results in the piezoelectric generation of a second voltage between electrodes 12 and 9. Similarly, when the polarity of the voltage across electrodes 4 and 8 is reversed, a second voltage of reverse polarity is developed between electrodes 12 and 8.

In the preferred embodiment of the invention the HDP transformer 1 is circular as viewed from above (as shown in FIG. 5) and of rectangular cross-section (as shown in FIG. 4). Circular shape of the HDP transformer 1 is desirable in step-up, narrow bandwidth transformer applications (such as when used in lamp ballast circuitry) because its symmetry reduces the introduction of interfering secondary and harmonic vibrations in the device. Asymmetric (i.e. non-circular, irregularly-shaped) geometry for the HDP transformer are desirable in broad bandwidth transformer applications because its asymmetry causes secondary and harmonic vibrations reduce resonant frequency spikes.

Figure 6:
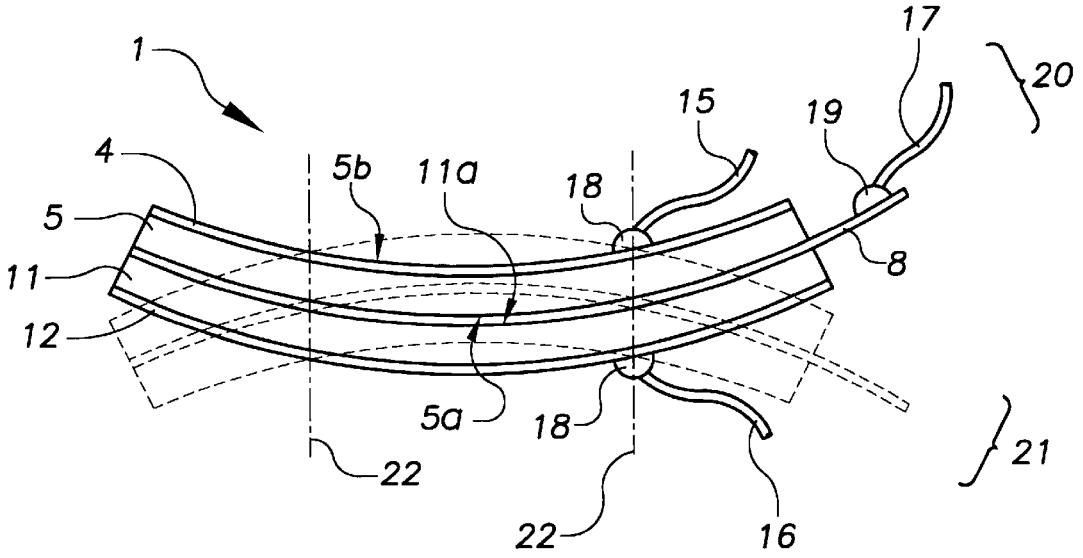
FIG. 6 is a schematic side view showing the flexing which the multi-layer piezoelectric transformer of FIG. 3 undergoes upon the application of voltage.

Referring now to FIG. 6: FIG. 6 is a schematic side view showing the flexing which the HDP transformer 1 undergoes upon the application of a voltage. FIG. 6 schematically illustrates a HDP transformer 1 having first and second piezoelectric ceramic layers 5 and 11 bonded along a longitudinal plane to and intermediate electrode 8. Electrodes 4 and 12 are disposed on the outboard opposing surfaces of ceramic layers 5 and 11, respectively. Ceramic layers 5 and 11 are electrically polarized in the manner described above.

When a voltage of a first polarity is applied between exterior electrode 4 and interior electrode 8, ceramic layer 5 begins to elongate in a direction substantially parallel to the longitudinal plane of the composite structure 1. In the case where ceramic layer 5 comprises a substantially flat disc, such application of a voltage of a first polarity will be understood to cause to ceramic layer 5 to tend to radially expand. Such radial expansion of ceramic layer 5 is opposed by ceramic layer 11, to which it is (indirectly) bonded at their respective interior surfaces 5*a* and 11*a*. Such radial expansion of ceramic layer 5 causes a tensile stress at the interior surface 11*a* of ceramic layer 11. This tensile stress at the interior surface 11*a* of ceramic layer 11 develops a moment in ceramic layer 11, which, in turn, causes ceramic layer 11 to curve as indicated by dashed lines (position 21) in FIG. 6. In addition, because the radial expansion of the interior surface 5*a* of the first ceramic is resisted by the compressive force of ceramic layer 11, while the radial expansion of the exterior surface 5*b* of ceramic layer 5 is not subjected to a similar force, ceramic layer 5 tends to curve as indicated by dashed lines (position 21) in FIG. 6.

When the frequency of the voltage applied between electrodes 4 and 8 is selected to match, or substantially match, the natural frequency of the HDP transformer 1, the composite structure will vibrate as illustrated in FIG. 6 (from position 20 to position 21). If the shape of the HDP transformer were rectangular (as viewed from above) the device would tend to vibrate in such a manner to have to nodes (as indicated at lines 22 in FIG. 6). If the shape of the HDP transformer is circular, as in the preferred embodiment of the invention, a circular node 22 would be established as illustrated in FIG. 5 and 6. Because the node 22 represents the position of minimum displacement of the vibrating HDP transformer 1, electrical leads 15 and 16 are preferably attached (for example by solder or conductive epoxy 18, or the like) at the node 22.

As will be appreciated by those skilled in the art, when the HDP transformer 1 is electrically actuated as described above so as to cause "lamb" wave resonant frequency vibration of the composite device, it is possible to achieve deformation of ceramic layers 5 and 11 one or more orders of magnitude greater than would be possible by planar piezoelectric deformation alone (such as in prior "Rosen-type" piezoelectric transformers). When an input voltage across ceramic layer 5 causes ceramic layer 5 to piezoelectrically deform, it, in turn mechanically causes ceramic layer 11 to deform, and such mechanically induced deformation of ceramic layer 11 piezoelectrically generates a second voltage across the electrodes 8 and 12 of ceramic layer 11. Because the achievable deformation is one or more orders of magnitude greater than is possible in prior Rosen-type transformers, the power transmission capacity of the described HDP transformer 1 is similarly one or more orders of magnitude greater than is possible in prior Rosen-type transformers of a similar size.

Below are described methods of using the HDP transformer 1 in gas discharge (particularly fluorescent) lamp ballast applications. In order to understand the operation of the HDP transformer in such applications, it is first useful to understand performance characteristics of the disclosed HDP transformer.

Figure 8:
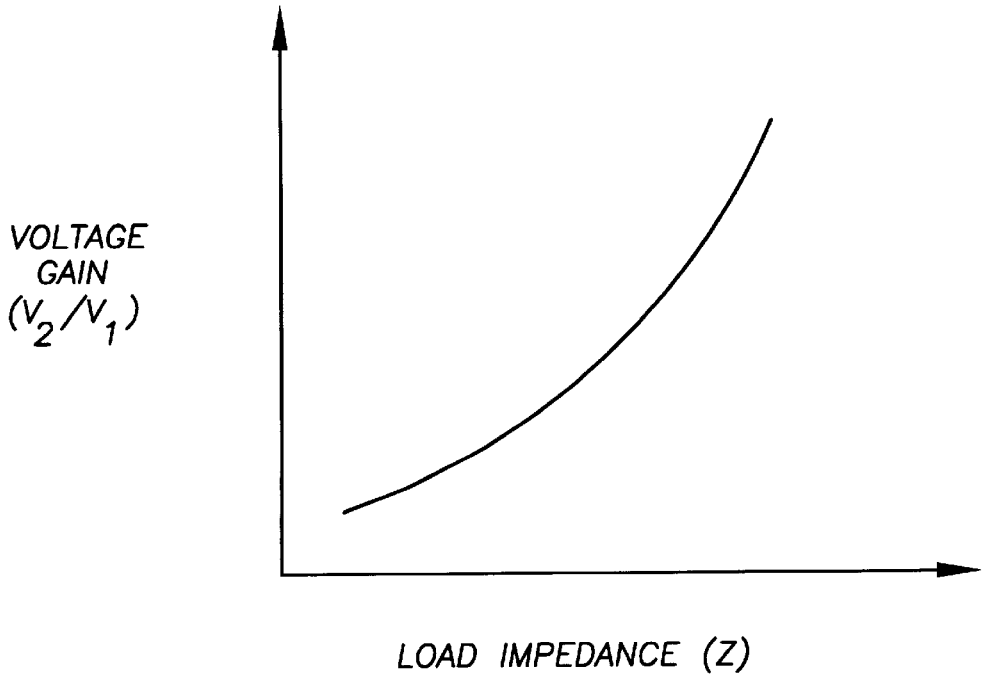
FIG. 8 is a graph plotting voltage gain versus load impedance of an exemplary multi-layer piezoelectric transformer used according to the principles of the present invention.
Figure 9:
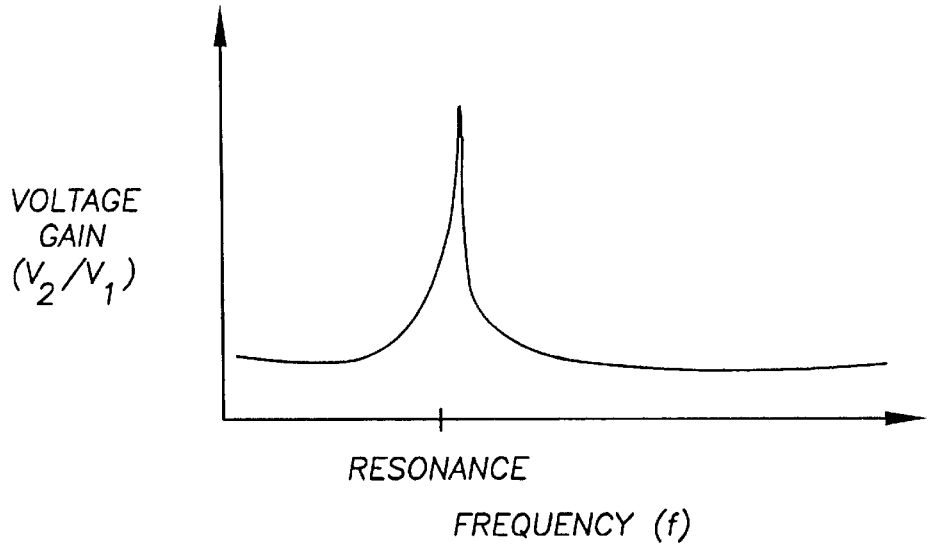
FIG. 9 is a graph plotting voltage gain versus frequency of an exemplary multi-layer piezoelectric transformer used in the preferred embodiment of the present invention.

FIGS. 8–9 illustrate performance characteristics of the disclosed HDP transformer 1. FIG. 8 is a graph plotting voltage gain versus load impedance of an exemplary HDP transformer 1 used according to the principles of the present invention. As can be seen in FIG. 8, the voltage gain of the HDP transformer 1 increases with increasing load impedance. As used herein, "voltage gain" refers to the ratio of the voltage input (V1) across the electrodes of a first piezoelectric ceramic layer (e.g. ceramic layer 5) to the voltage output (V2) across the electrodes of a second ceramic layer (e.g. ceramic layer 11) of an HDP transformer. Thus it will be understood from a review of FIG. 8 that when the HDP transformer 1 is used in an electrical circuit in which a constant (albeit AC) first voltage is applied across the electrodes of the first ceramic layer (e.g. ceramic layer 5) and a load of variable impedance is applied across the electrodes of the second ceramic layer (e.g. ceramic layer 11), the voltage developed across the electrodes of the will automatically increase as the impedance of the load increases, and will automatically decrease as the impedance of the load decreases.

FIG. 9 is a graph plotting voltage gain versus frequency (at constant load impedance) of an exemplary HDP piezoelectric transformer 1 used in the preferred embodiment of the present invention. As described above, in the preferred embodiment of the invention the HDP transformer 1 is a multi-layer composite structure having a generally right cylindrical shape. Accordingly, it will be understood that the preferred embodiment of the HDP transformer 1 is symmetrical in two dimensions. For such a symmetric HDP transformer the maximum voltage gain occurs at the natural (resonant) frequency of the device; and, as illustrated in FIG. 9, such relatively high voltage gain is achieved over a relatively narrow bandwidth.

Figure 10:
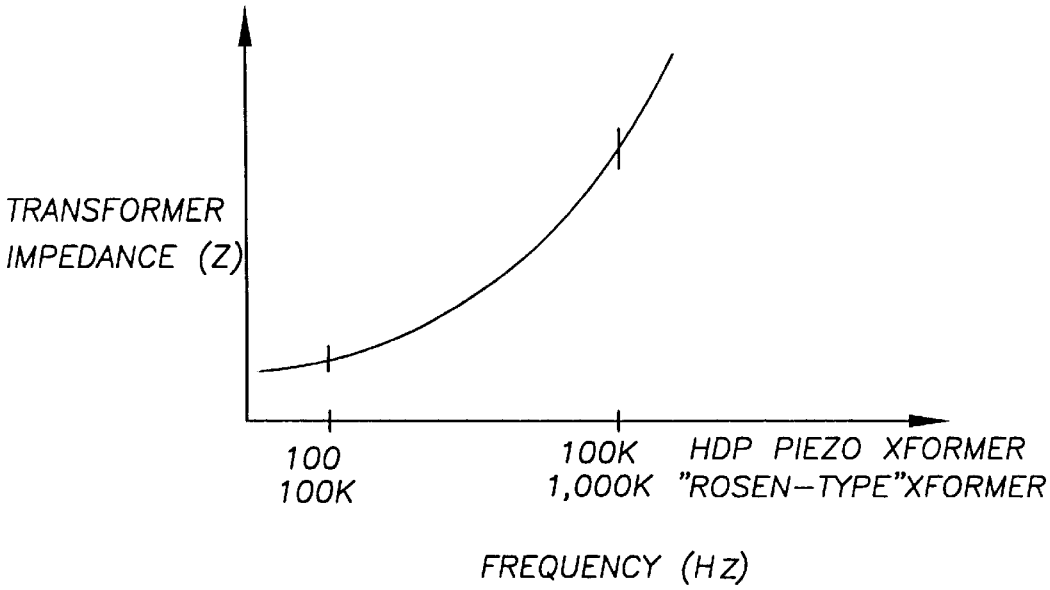
FIG. 10 is a graph comparing transformer impedance versus frequency for an exemplary multi-layer piezoelectric transformer used in the preferred embodiment of the present invention and a typical prior Rosen-type transformer.

FIG. 10 is a graph comparing internal transformer impedance versus input voltage frequency for an exemplary HDP piezoelectric transformer 1 used in the preferred embodiment of the present invention and a typical prior Rosen-type transformer. As illustrated in FIG. 10, the internal impedance of the typical HDP piezoelectric transformer (1), in the frequency range of 100 Hz to 100 kHz (i.e. the operating frequency range of common fluorescent lamp ballasts), is much greater than that of prior Rosen-type transformers of comparable size. Accordingly, it will be understood that circuit design is more simple when using HDP transformer 1 than prior Rosen-type transformers, because it is much easier to match (and maintain a match of) the impedance of the HDP transformer 1 than to match (and maintain a match of) the impedance of common prior Rosen-type transformers.

FLUORESCENT LAMP EXCITATION CIRCUIT

Figure 11:
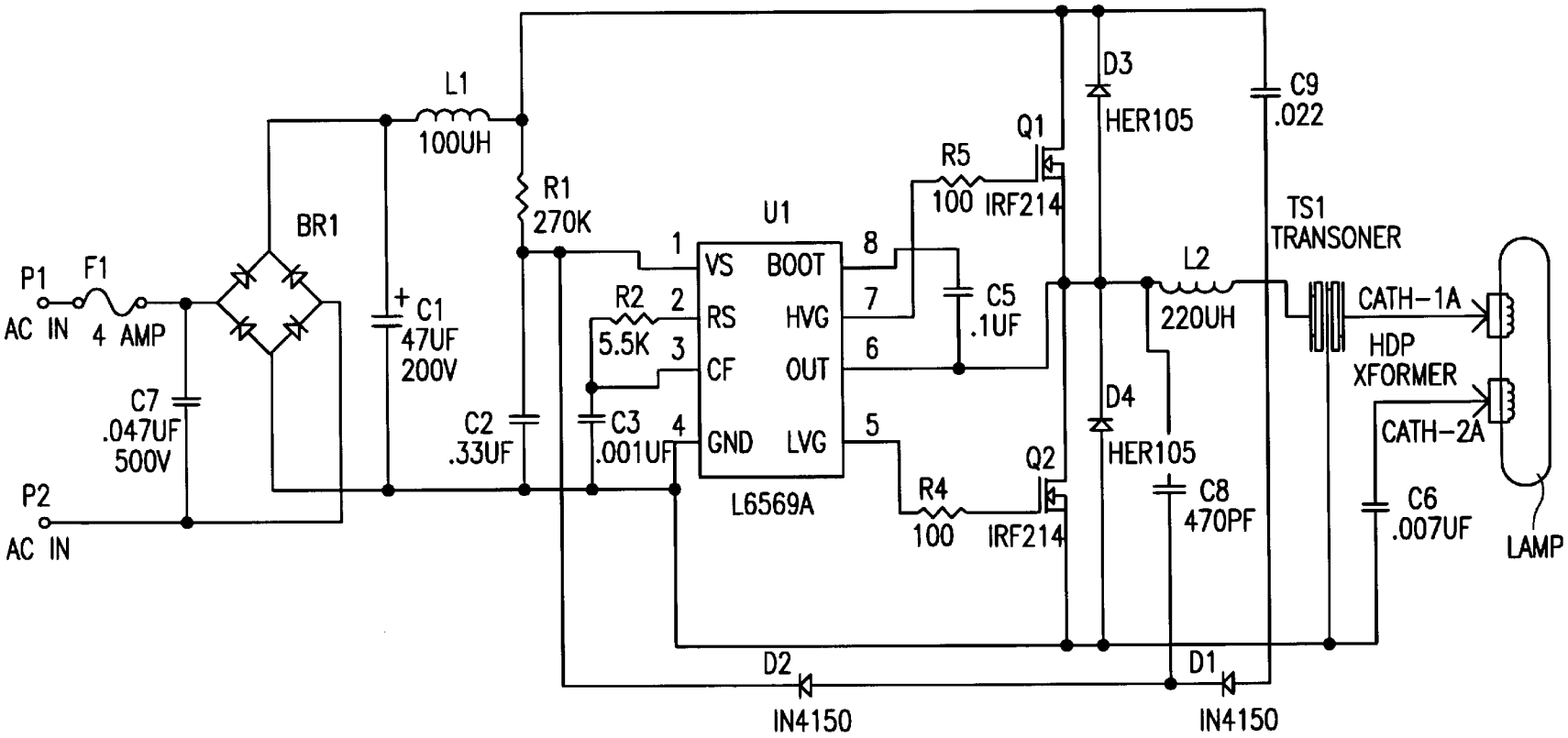
FIG. 11 is a schematic diagram of one exemplary embodiment of a fluorescent lamp power-supply and control circuit which incorporates principles of the present invention.

Referring now to FIG. 11: FIG. 11 is a schematic diagram of one exemplary embodiment of a fluorescent lamp power-supply and control circuit which incorporates principles of the present invention. The particular values of the components shown in FIG. 11 are those that my be used in a 28 watt fluorescent lamp power-supply and control circuit that incorporates principles of the present invention.

Figure 12:
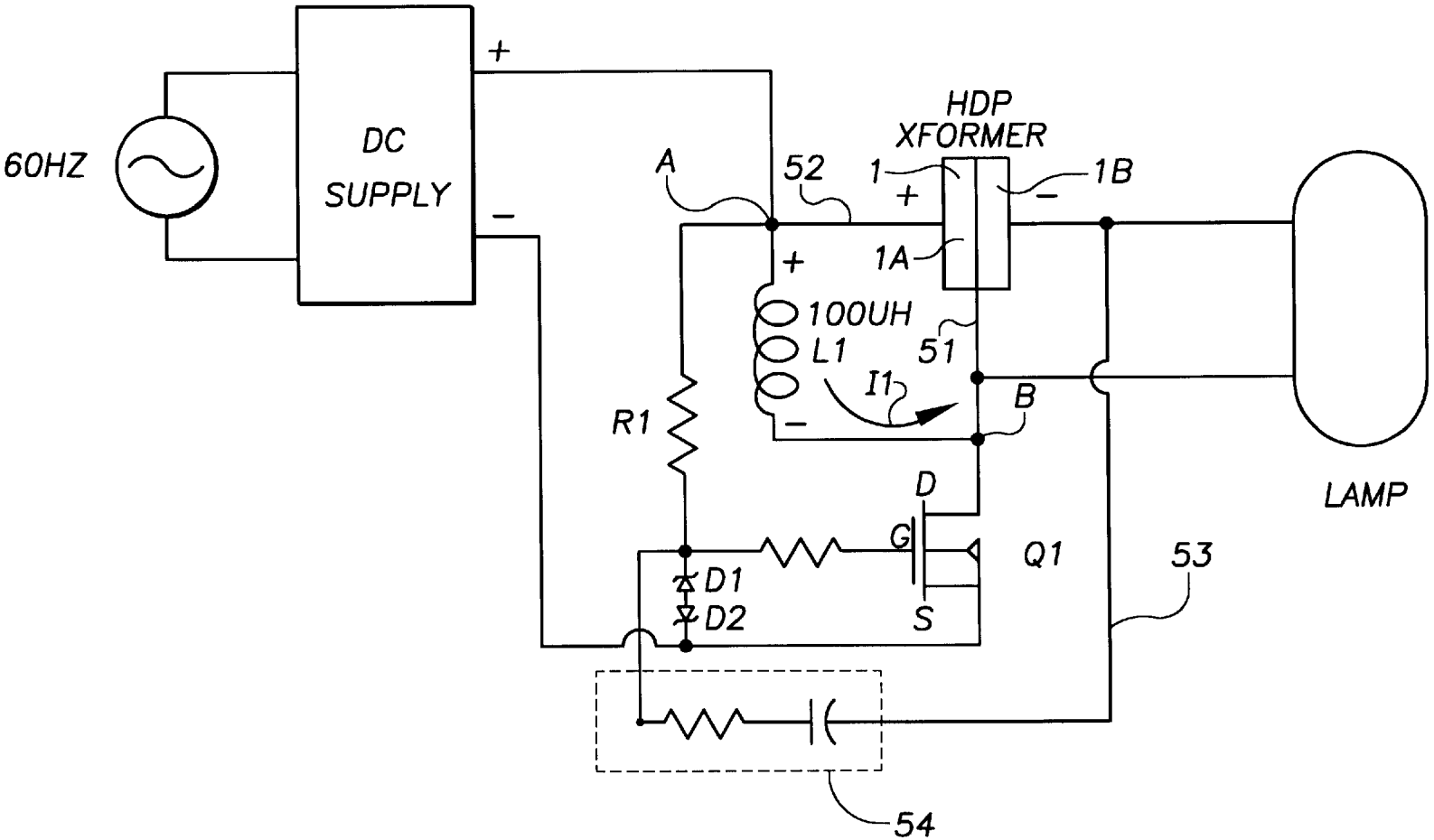
FIG. 12 is a schematic diagram of further exemplary embodiment of a fluorescent lamp power-supply and control circuit which incorporates principles of the present invention.

This circuit comprises an oscillator U1 driver device. The circuit elements are illustrated in the accompanying drawing figure by common electrical symbols, except for the HDP transformer which is indicated in the circuit drawings (i.e. FIGS. 11 and 12) by the reference number 1. It will be understood that the HDP transformer 1 which is referred to in the circuits of FIGS. 11 and 12 is the HDP transformer 1 which is described in detail herein above and corresponding FIGS. 3–10.

In the circuit illustrated in FIG. 11, the output of a HDP transformer 1 is used to drive high frequency voltage directly to a fluorescent lamp. As will be discussed more fully below, the HDP transformer advantageously vibrates at or near its natural frequency, and, in so doing produces an electrical signal of substantially constant high frequency, but at a voltage that automatically advantageously varies according to the status of the fluorescent lamp—that is, whether the lamp has been fired.

A fluorescent lamp ballast circuit, such as is illustrated in FIG. 11, does not require different start-up and operating frequencies. Accordingly, several of the components (and their respective functions) which are found in prior electronic ballast circuits are not required in the present circuit.

As discussed above, the HDP transformer 1 converts electrical energy into mechanical energy. The mechanical energy is then converted back into electrical energy. The magnitude of that mechanical energy determines the voltage gain of the device. Under no load (i.e., open circuit) conditions there is more mechanical motion in the HDP transformer than in high load conditions. This is inherently so in the HDP transformer 1 because when no charge is removed from the secondary (i.e. output) side it is capable of moving more freely. When the device (1) moves freely it generates a greater voltage gain. This greater voltage gain under no load conditions is taken advantage of in the present circuit by applying greater voltage to the load (i.e. to the lamp) when there is no or low load (i.e. when the lamp is initially turned on and draws no or little power from the transformer).

When the lamp is not fired the lamp circuit presents very little load to the HDP transformer 1. This small load results from a very slight parasitic capacitance load. Under this condition, the voltage gain, and therefore the voltage out, of the HDP transformer 1 is high. Since the voltage out of the HDP transformer 1 is high, the voltage to the lamp is high. The lamp can be fired in "cold cathode" mode. That is: the cathode(s) of the lamp is (are) not pre-heated.

When the lamp fires, it goes to a lower temperature state, which lowers the resistance of the lamp (to 400 OHM). At lower resistance, the lamp begins drawing more current. This current is the moving charge that is removed from the secondary side of the HDP transformer 1. As the electrical field decreases at the secondary side of the HDP transformer 1, the deflection of ceramic layer 11 is reduced. This reduces the amplitude of the movement/oscillation of the HDP transformer 1, which reduces the voltage gain of the device. Accordingly, it will be understood that the HDP transformer 1 provides a variable voltage which depends on the impedance of the load, such that the gain of the device is high for zero/light loads (with high impedance) and the gain of the device is low for high loads (with lower impedance).

In prior (e.g. wire wound, electromagnetic) transformers used in lighting ballast circuits, the transformer typically has a fixed output impedance and, for maximum power transfer, it is necessary to have a low impedance load matched to that output impedance. For such prior circuits, at any other (i.e. unmatched) impedance it is not possible to achieve maximum power transfer, and, accordingly, the inefficiency of the ballast increases. In addition, in such prior transformers the voltage gain is depends predominately on the ratio of the turns of the coils (a fixed number) and the frequency of the signal.

However, it will be understood that, since an HDP transformer 1 constructed in accordance with the present invention has variable voltage gain and because the voltage ratio changes with the load, there is a relatively wide range of load resistances at which it can achieve very high efficiencies. This characteristic enables the present circuit to fire the lamp and then automatically match the lamp's impedance after the lamp is running.

Referring again to FIG. 11: Resistor R1 provides a start up-current, and capacitor C2 provides filtering of the power supply voltage, for the oscillator U1. Oscillator U1 drives the circuit. Boot strap capacitor C5 is provided between pins 8 and 6 of the oscillator U1. Two N-channel FETS Q1 and Q2 are connected to the high voltage gate (pin 7) and low voltage gate (pin 5), respectively of the oscillator U1. Resistors R4 and R5 (100 ohm each) are in series with the gates of FET Q1 and Q2, respectively, to limit the current drawn by the FETS Q1 and Q2 as the FETS Q1 and Q2 switch. While the FETS Q1 and Q2 are switching they dissipate the most amount of power. Therefore, it is desirable to limit the switching current of the FETS. The switching current can be limited by improving the rise time of the signal input to the FETS Q1 and Q2. Capacitor C8 and diodes D1 and D2 are small switching power supply combinations that provide the current during operation.

During each cycle of operation, the negative resistance characteristic of the lamp (that is, the characteristic that the lamp resistance goes down after the lamp fires) causes the load that's seen by the HDP transformer 1 to increase as the voltage increases. Since the lamp voltage is relatively lower while the lamp is running, the peak current to the lamp is also lower, and, therefore, the RMS to peak current ratio is also lower. By way of example, an AC source supplied to a resistor typically has a sine wave current in which the peak to RMS ratio is 1.414, the square root of 2. This ratio is known as the "crest factor". New government regulations encourage the use of low crest factor devices. In addition, lowering crest factor improves the life of many electrical devices, in particular fluorescent lamps.

In the present circuit (shown in FIG. 11), the peak current is lowered by HDP transformer's 1 interacting with the lamp. Accordingly, the crest factor of the HDP transformer 1 voltage output is better (i.e. lower) than that of a true sine wave. In the embodiment of the invention described herein, the crest factor is approximately 1.2. This improvement in crest factor if accomplished in the present invention because the lamp operates as a negative resistance and the HDP transformer 1 has a variable voltage gain with load. Thus, as the lamp load changes per cycle it affects the ratio of the peak current to RMS current. The result of this effect is that the curve of the current versus is a little "flatter" than square wave but still very much like the sine wave.

The efficiency of HDP transformer s 1 constructed in accordance with the foregoing description and used in circuits according to the foregoing description has been measured to be approximately 98%. By "efficiency of the HDP transformer", what is meant here is the ratio of the power out of the HDP transformer 1 to the power input to it.

Figure 1:
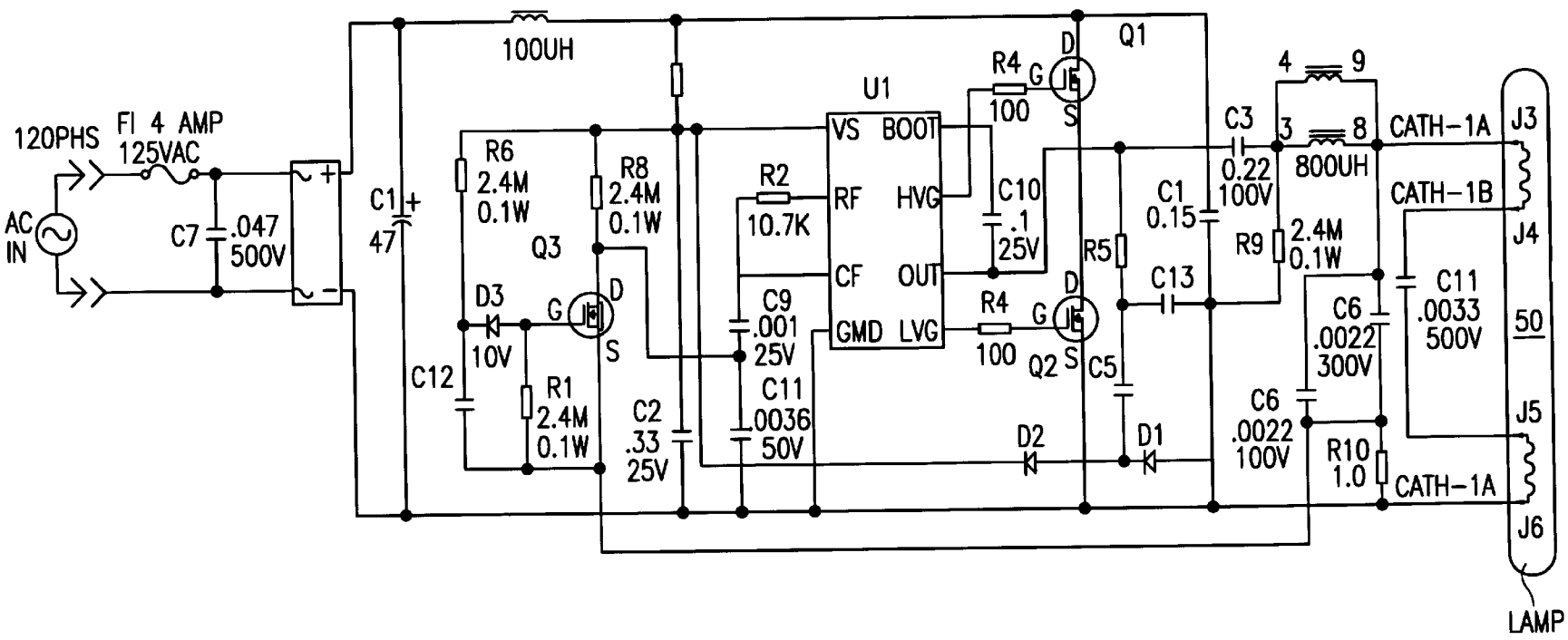
FIG. 1 PRIOR ART
FIG. 1 is a schematic diagram of a prior fluorescent lamp electronic power-supply and control circuit which includes an IC oscillator component.
Figure 2:
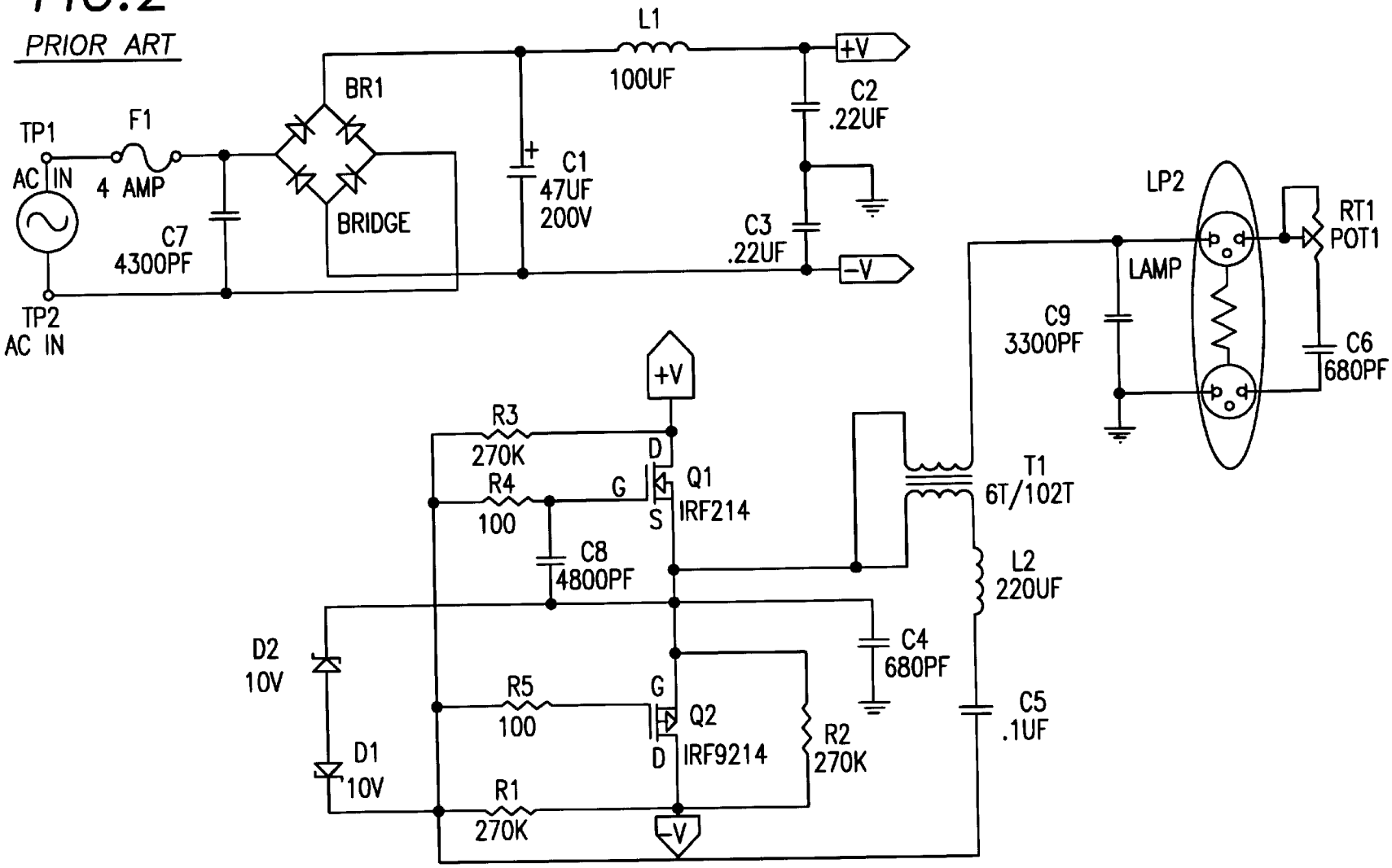
FIG. 2 PRIOR ART
FIG. 2 is a schematic diagram of a prior fluorescent lamp power-supply and control circuit which includes a magnetic transformer component.

The efficiency of the system constructed and operated in accordance with the foregoing description has been measured to be approximately 84% to 86%. By "efficiency of the system", what is meant here is the ratio of the power utilized in the actual lighting (i.e. less circuit component losses) of the lamp to the total power supplied to the circuit. The efficiency measured in the instant circuit is comparable to the measured efficiencies of typical prior circuits (for example those illustrated in FIGS. 1 and 2). However, the ratio of lumens per watt of power being supplied to the entire system is about 10% higher in the instant invention that that achieved by typical prior circuits (for example those illustrated in FIGS. 1 and 2). The improved lumens-to-watt ratio realized with the instant invention is due, in part, to the improved current wave shape's interaction with the lamp. Although it may theoretically be possible to electronically reshape the wave form of prior electronic lamp ballast circuits to provide improved wave form, any such reshaping would take at least several electronic/electrical components, whereas the instant invention accomplishes the same directly by the use of the HDP transformer 1.

Referring now to FIG. 12: FIG. 12 is a schematic diagram showing a second exemplary embodiment of a fluorescent lamp power-supply and control circuit which incorporates principles of the present invention. This circuit, too, relies on an HDP transformer 1 to provide high frequency current to power a gas discharge (e.g. fluorescent) lamp.

At the input section of the circuit there is a DC supply that, depending on the power level desired for the particular application, may produce ±85 volts or, alternatively, ±170 volts.

The HDP transformer 1 to lamp interaction are similar in many respects to that described above with respect to FIG. 11. The circuitry that drives the HDP transformer 1 of FIG. 12 differs from that illustrated in FIG. 11, and will be described below. The positive side of the supply comes into point A. Initially the voltage of the gate of FET Q1 is pulled up by a resistor R1 of high value, which causes FET Q1 to turn on. When FET Q1 is turned on, current begins to flow through the inductor L1. At the same time the voltage at point B, which is the voltage on the low side of the HDP transformer 1 is pulled low.

The circuitry on the input 52 (primary) side of the HDP transformer 1 begins to charge and so the input side of the HDP transformer achieves a positive charge, while and the center electrode/lead 51 of the HDP transformer 1 is near ground.

An electric field is established between the input 52 and the "ground" electrode 51.

The HDP transformer 1 is vibrated (by electrical excitation of the "primary" ceramic layer) in order to generate voltage for the lamp. Initially, (i.e. at the very beginning of operation, during the first 1–3 cycles) that voltage becomes high enough to fire the lamp. This may take a few microseconds, in order for the HDP transformer 1 to vibrate back and forth a few times sufficiently for the amplitude of the vibrations (and, therefore, the voltage generated) to build up to a high value.

The HDP transformer 1 flexes on its first cycle and it generates a voltage. This voltage is fed back (via line53) to the gate of the FET Q1. That in turn causes the gate to turn off. When the gate turns off, the magnetic field in the inductor L1 begins to collapse. This causes the current to continue flowing. The positive charge that has built up on the input side 1A of the HDP transformer 1, flows out of the HDP transformer 1, through the inductor L1 and into the ground area of the inductor L1, as indicated in FIG. 12 by reference l1.

As the magnetic field at the inductor L1 continues to collapse, the HDP transformer 1 now flexes back in the opposite direction and the HDP transformer 1 begins to accumulate negative charge at the input side 1A of the HDP transformer. Since the HDP transformer is now flexing in the opposite direction, the FET Q1 will now turn on. When the FET Q1 turns back on, a similar situation exists as before. The charge is taken out of the ground area 51 of the HDP transformer 1 and then current increases in the inductor L1. This is somewhat analogous to the operation of a fly-back boost switching power supply, but in the instant invention the HDP transformer 1 acts as a capacitive element, and the inductor is switched.

The described cycle keeps repeating, as the HDP transformer 1 output changes polarity, the gate of the FET Q1 turns on and off in synchronization with the tuning of the circuit. After a few cycles of operation, the voltage at the output 53 of the HDP transformer rises high enough to fire the lamp.

After the lamp fires, the voltage gain ratio of the HDP transformer 1 will change (i.e. drop), and the voltage applied to the lamp will advantageously drop.

Back-to-back zener diodes D1 and D2 are located between the gate and source of the FET Q1, as illustrated in FIG. 12. In addition, R-C phase adjustment components 54 may be used in the feed back line 53.

The HDP transformer 1 output signal normally lags the input driving signal by 90 degrees at resonance. The input side of an HDP transformer has a real capacitance. At resonance it also has a large imaginary (i.e. "mechanical") capacitance and inductance. This is also present in the output side of the HDP transformer 1. So, there exists a lag in the signal. This lag may be adjusted (either increased by up to 90 degrees to reduced by up to 90 degrees) by the R-C phase adjustment components.

Voltage is what turns the gate of the FET Q1 on—not a current. So, by having the polarity of the HDP transformer 1 output oriented correctly a phase lead can be generated. Then phase lag can be introduced in the feedback circuit (i.e. by R-C phase adjustment components 54) so the FET Q1 switches at precisely the right time. That is: at the 0 voltage point. In this manner very high operational efficiency can be achieved by switching FET Q1 at the 0 voltage point.

Accordingly, it will be understood from the above disclosure that an HDP transformer 1 constructed in accordance with the present invention has inherent fundamental characteristics that are conducive to its being used as a step-up transformer in a gas discharge lamp power-supply and control circuit.

It will also be understood from the above disclosure that an HDP transformer 1 constructed in accordance with the present invention has a relatively higher power transmission capability that comparably sized prior magnetic transformers and prior piezoelectric transformers.

It will also be understood that among those inherent characteristics is that the voltage gain of device, under certain operational conditions, varies substantially proportionately with the resistance of the load (i.e. at higher resistance, gain of the device is higher; at lower resistance, gain of the device is lower).

It will also be understood from the above disclosure that an HDP transformer 1 constructed in accordance with the present invention can be manufactured made smaller than conventional magnetic transformers and prior piezoelectric transformers of comparable power handling capacity.

Furthermore, it will be understood from the above disclosure that an HDP transformer 1 constructed in accordance with the present invention may be use in conduction with an electrical circuit pursuant to the principles described herein above may advantageously used to provide a fluorescent lamp excitation circuit that can be made smaller and simpler than conventional circuits using magnetic step-up transformers or prior piezoelectric transformers.

In addition, it will be understood from the above disclosure that an HDP transformer 1 constructed in accordance with the present invention may be use in conjunction with an electrical circuit pursuant to the principles described herein above may advantageously used to provide a fluorescent lamp excitation circuit that does not require a sinusoidal input in order to generate a high-frequency, high-voltage, AC transformer output.

As discussed above, the HDP transformer 1 that is used in the preferred embodiment of the invention, (i.e. in a gas fluorescent lamp ballast circuit application) is preferably circular in shape. The reason circular shape is preferred relates to the degrees of freedom of the device. A circular (or disc) shape HDP transformer has only a limited number of modes at which it can vibrate. By way of comparison, a square is not geometrically uniform about any point. A rectangle is even less uniform, and, therefore, can vibrate in several different modes. It will be appreciated then, that the power transmission capability of the HDP transformer depends on the efficiency by which it transfers mechanical (i.e. vibration) energy from one ceramic layer to the other. The more modes of vibration, the less efficiently that energy is transmitted.

The HDP transformer vibrates in either the fundamental mode of vibration in harmonics of same. Dissipation within the ceramic is directly related to the operation frequency. Therefore, when the frequency of vibration increases, heat generation and dissipation within the ceramic increases. So, if the device is operating at a harmonic (rather than the fundamental) mode, any part of the ceramic may be vibrating and the amount of power dissipation will be relatively higher.

Accordingly, in the preferred embodiment of the invention (wherein high power transmission efficiency is desirable) it is desirable that a symmetric (i.e. circular) HDP transformer be used. However, in certain other applications (for example in wide bandwidth signal transmission) wherein constancy of voltage gain over a wide signal input frequency range is desirable, it is preferable that the HDP transformer be asymmetrically shaped.

As discussed above, in the preferred embodiment of the invention the HDP transformer comprises a first ceramic disc and a second ceramic disc which are bonded together with an intermediate electrode 8 (preferably copper) layer therebetween. In the preferred method of manufacturing the HDP transformer the ceramic discs 5 and 11 have electro-deposited electrodes 4, 6, 10 and 12 on their major planar faces.

In addition, supplemental copper electrodes 2 and 14 are bonded to the opposite outboard planar surfaces of the bonded ceramic layers. The supplemental electrode layers 2 and 14 provide good mechanical and electrical connection between the wire leads and the electro-deposited electrodes 4 and 12. However, it is within the scope of the invention to provide a modification of the HDP transformer that is manufactured without one or more of the supplemental electrodes 2 and 14. In addition, the supplemental electrodes 2 and 4 and the intermediate electrode 8 can be made of conductive materials other than copper.

In the preferred embodiment of the invention the various described layers are bonded together with "Cibageigy AV118" epoxy. During manufacture of the HDP transformer 1 the composite layers of the transformer are clamped together and heated to a temperature of at least 121 degrees C., which is the activation temperature of the epoxy. In order to accelerate the curing process the temperature may be advantageously raised to 150–175 degrees C., well below the curie temperature of the ceramic layers of the device. The "Cibageigy AV118" epoxy is preferred because it provides a strong bond between the layers of the HDP transformer and can be cured at a temperature below the curie temperature of the ceramic layers. However, other methods of bonding the various layers (i.e. the ceramic and electrode layers) of the device together may be used, including other epoxies (both conductive and non-conductive), ultrasonic welding, polyimide adhesives and cofiring.

In the preferred embodiment of the HDP transformer the ceramic layers are made of a very hard piezoelectric ceramic material, for example ceramic #841 as manufactured and sold commercially by American Piezo Ceramics, Inc. of Mackeyville, Pa. The ceramic material preferably has a high deflection per volt, a high curing temperature, does not "depole" very easily, and is hard. A material having these attributes will typically have a high "Q" rating (i.e. the power per cycle in the device divided by the power per cycle that is needed maintain the device at that power level must be high). The Q-rating of the ceramic used in the preferred embodiment of the invention is 1400.

In the fluorescent lamp excitation circuits described herein above, the HDP transformer is approximately ¾" diameter and nominally operates (i.e. resonates) at a frequency of 125 kHz. The operating frequency of the HDP transformer depends, in part, on the relationship between the thicknesses of the ceramic layers 5 and 11 on the input and output sides, respectively, of the transformer. In the preferred embodiment of the invention, the thickness of the ceramic layer 5 on the input side of the transformer is in the range of 0.030 to 0.100 inches; and the thickness of the ceramic layer 11 on the output side of the transformer is in the range of 0.090 to 0.100 inches. Generally speaking, it appears that if the output-side ceramic (11) is too thin then the voltage gain will be too low for use in the above described circuits; however, the input-ceramic (5) thickness is preferably somewhat thinner than the thickness of the output ceramic layer (11), which condition provides a better wave form (as described above) and less energy dissipation within the ceramic layers themselves.

While the above description contains many specificities, these should not be construed as limitations on the scope of the invention, but rather as an exemplification of one preferred embodiment thereof. Many other variations are possible, for example:

While in the preferred embodiment of the invention the ceramic layers 5 and 11 are preferably constructed of a PZT ceramic material, other electroactive materials may be used in their place;

Circuits conforming to the principles of the described invention can be used to power devices other than fluorescent lamps, including other gas discharge lamps;

Multiple HDP transformers 1 can be connected in parallel to cumulatively transmit greater power to the lamp (or other driven device) than may be possible with one transformer alone; and, While in the preferred embodiment of the invention both opposing major faces of each of the ceramic layers 5 and 11 are pre-coated with electro-deposited electrodes, it is within the scope of the present invention to construct the HDP transformer from ceramic layers that have their outboard surfaces electroplated, provided that the transformer is constructed such that the center electrode 8 is either intimately in contact with each of the ceramic layers (e.g. such as by ultrasonic welding or cofiring) or an electrically conductive adhesive is used to bond the ceramic layers to the center electrode 8.

Accordingly, the scope of the invention should be determined not by the embodiment illustrated, but by the appended claims and their legal equivalents.

What is claimed is:

1. A gas discharge lamp control circuit comprising:

a DC voltage source;

said DC voltage source having first and second output terminals, a voltage at said first output terminal from said DC voltage source being higher than a voltage at said second output terminal from said DC voltage source;

a piezoelectric transformer;

said piezoelectric transformer comprising a first piezoelectric ceramic layer and a second piezoelectric ceramic layer, said first piezoelectric ceramic layer having first and second major faces, said first and second major faces of said first piezoelectric ceramic layer being substantially parallel to each other;

said first piezoelectric ceramic layer being polarized such that when a first input voltage is applied across said first and second major faces of said first piezoelectric ceramic layer, said first piezoelectric ceramic layer longitudinally deforms in a direction substantially parallel to said first and second major faces of said first piezoelectric ceramic layer;

said second piezoelectric ceramic layer having first and second major faces, said first and second major faces of said second piezoelectric ceramic layer being substantially parallel to each other;

said second piezoelectric ceramic layer being polarized such that when said second piezoelectric ceramic layer is longitudinally deformed in a direction substantially parallel to said first and second major faces of said second piezoelectric ceramic layer, a first output voltage is generated across said first and second major faces of said second piezoelectric ceramic layer said first piezoelectric ceramic layer and said second piezoelectric ceramic layer being bonded together such that said first major face of said first piezoelectric ceramic layer and said first major face of said second piezoelectric ceramic layer are facing toward each other, and said second major face of said first piezoelectric ceramic layer and said second major face of said second piezoelectric ceramic layer are facing away from each other;

said first output terminal from said DC voltage source being electrically connected in series to said second major face of said first piezoelectric ceramic layer;

a transformer output terminal electrically connected to said second major face of said second piezoelectric ceramic layer;

said transformer output terminal being adapted to be electrically connected to a first terminal of a gas discharge lamp;

A field effect transistor with a source, a gate and a drain;

a transformer common conductor electrically connected to said first major faces of said first and second piezoelectric ceramic layers;

said transformer common conductor being electrically to the drain of said field effect transistor;

an inductor electrically connected in series between said second major face of said first piezoelectric ceramic layer and said common conductor;

said gate of said field effect transistor being electrically connected in series with said transformer output terminal; and said source of said field effect transistor being electrically connected in series with said second output terminal of said DC voltage source.

* * * * *